US006418893B1

(12) United States Patent
Auchter et al.

(10) Patent No.: US 6,418,893 B1
(45) Date of Patent: Jul. 16, 2002

(54) DEVICE FOR VARYING VALVE TIMING OF GAS EXCHANGE VALVES OF AN INTERNAL COMBUSTION ENGINE, IN PARTICULAR A HYDRAULIC CAMSHAFT ADJUSTING DEVICE OF A ROTARY PISTON TYPE

(75) Inventors: Jochen Auchter, Aurachtal; Andreas Strauss, Forchheim, both of (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 09/696,576

(22) Filed: Oct. 25, 2000

(30) Foreign Application Priority Data

Oct. 26, 1999 (DE) ..... 199 51 391

(51) Int. Cl.[7] ..... F01L 1/34

(52) U.S. Cl. ..... 123/90.15; 123/90.17; 123/90.31; 123/90.12

(58) Field of Search ..... 123/90.15, 90.17, 123/90.12, 90.31, 90.33, 90.34; 74/567, 568 R

(56) References Cited

U.S. PATENT DOCUMENTS

| | | | | |
|---|---|---|---|---|
| 4,858,572 A | * | 8/1989 | Shirai et al. | 123/90.12 |
| 5,724,929 A | * | 3/1998 | Mikame et al. | 123/90.17 |
| 5,924,395 A | * | 7/1999 | Moriya et al. | 123/90.15 |
| 5,937,808 A | * | 8/1999 | Kako et al. | 123/90.15 |
| 5,957,095 A | * | 9/1999 | Kako | 123/90.15 |
| 6,024,061 A | * | 2/2000 | Adachi et al. | 123/90.17 |
| 6,039,016 A | * | 3/2000 | Noguchi | 123/90.17 |
| 6,135,077 A | * | 10/2000 | Moriya et al. | 123/90.17 |
| 6,161,511 A | * | 12/2000 | Hashimoto | 123/90.15 |
| 6,269,785 B1 | * | 8/2001 | Adachi | 123/90.17 |

FOREIGN PATENT DOCUMENTS

| | | |
|---|---|---|
| DE | 19849959 | 5/1999 |
| EP | 0801212 | 10/1997 |

* cited by examiner

*Primary Examiner*—Teresa Walberg
*Assistant Examiner*—Fadi H. Dahbour
(74) *Attorney, Agent, or Firm*—Bierman, Muserlian and Lucas

(57) ABSTRACT

The invention relates to a hydraulic camshaft adjusting device (1) of a rotary piston type that is disposed on a camshaft (3) mounted in the cylinder head (2) of an internal combustion engine and comprises a drive pinion (4) that is in driving relation with a crankshaft through a gearing (6), and a winged wheel (5) that is fixedly mounted on the camshaft (3). The drive pinion (4) is made up of a circumferential wall (7), a camshaft-distal side wall (8) and a camshaft-proximate side wall (9), which walls (7, 8, 9) together define a hollow space (10) in which at least one hydraulic working chamber is formed by at least two limiting walls (11). The winged wheel (5) comprises at least one wing (14), and each wing (14) divides a hydraulic working chamber into two hydraulic pressure chambers. In accordance with the invention, the camshaft-proximate side wall (9) of the drive pinion (4) is configured as a weight- and design space-saving thin-walled component which is shaped out of a circular blank and comprises a bent edge region (17) that is bent at a right angle and partially surrounds the circumferential wall (7) of the drive pinion (4), said camshaft-proximate side wall (9) being undetachably fixed to the drive pinion (4) by a separate connection (18).

10 Claims, 6 Drawing Sheets

DEVICE FOR VARYING VALVE TIMING OF GAS EXCHANGE VALVES OF AN INTERNAL COMBUSTION ENGINE, IN PARTICULAR A HYDRAULIC CAMSHAFT ADJUSTING DEVICE OF A ROTARY PISTON TYPE

FIELD OF THE INVENTION

The present invention relates to a device for varying valve timing of gas exchange valve of an internal combustion engine, and in particular to a hydraulic camshaft adjusting device of a rotary piston type, wherein:

- the device is disposed on a drive-proximate end of a camshaft mounted in the cylinder head of the internal combustion engine and generally comprises a drive pinion configured as an outer rotor and a winged wheel configured as an inner rotor;
- the drive pinion is in driving relation with a crankshaft of the internal combustion engine through a circumferential gearing, and the winged wheel is fixedly mounted on the camshaft;
- the drive pinion comprises a hollow cylindrical circumferential wall, a camshaft-distal side wall and a camshaft-proximate side wall, said circumferential and side walls being connected to one another and together defining a hollow space;
- at least one hydraulic working chamber is formed in the hollow space of the drive pinion by at least two limiting walls that start from an inner side of the circumferential wall and extend in radial direction toward a central longitudinal axis of the device;
- a hub of the winged wheel comprises at least one wing on a periphery thereof which wing extends in radial direction into the working chamber of the drive pinion and divides the working chamber into two hydraulic pressure chambers;
- a rotation or a fixing of the winged wheel relative to the drive pinion, and thus also of the camshaft relative to the crankshaft, is effected respectively by a selective or a simultaneous pressurization of the pressure chambers with a hydraulic pressure medium.

BACKGROUND OF THE INVENTION

A device of the pre-cited type is disclosed in the German document DE-OS 198 29 049. This device is arranged on the drive-proximate end of a camshaft mounted in the cylinder head of the internal combustion engine and generally comprises a drive pinion configured as an outer rotor and a winged wheel configured as an inner rotor. The drive pinion of the device is in driving relation with a crankshaft of the internal combustion engine through a circumferential gearing, and the winged wheel is fixedly mounted on the camshaft of the internal combustion engine. The drive pinion further comprises a hollow cylindrical circumferential wall, a camshaft-distal and a camshaft-proximate side wall, which walls are connected to one another and to a gearing, made in the described embodiment as a separate annular toothed belt pulley, by a number of screw connections and together define a hollow space. Six hydraulic working chambers are formed in the hollow space of the drive pinion by six limiting walls that start from an inner side of the circumferential wall and extend in radial direction toward the central longitudinal axis of the device. Each working chamber is divided into two hydraulic pressure chambers by a wing of the winged wheel arranged on the periphery of the hub of the winged wheel and extending in radial direction into each working chamber. These pressure chambers can be selectively or simultaneously pressurized by a hydraulic pressure medium so that a rotation or a hydraulic fixing of the winged wheel relative to the drive pinion, and thus also a rotation or a fixing of the camshaft relative to the crankshaft is effected.

From the device of a similar structure for effecting a rotation of a camshaft relative to a crankshaft of an internal combustion engine disclosed in U.S. Pat. No. 4,858,572, it is also known to configure the circumferential wall and the camshaft-proximate wall of the drive pinion together with a circumferential gearing for a toothed belt as a one-piece shaped component on which a camshaft-distal side cover is screwed to thus form a hollow space. In this hollow space, too, six hydraulic working chambers are formed by limiting walls extending from the inner side of the circumferential wall. However, in this device, the first three working chambers can be pressurized by a hydraulic pressure medium only in one direction of rotation, and the second three working chambers, only in the other direction of rotation for realizing a rotation or a fixing of the winged wheel relative to the drive pinion.

A drawback of these prior art devices, however, is that, particularly due to the solid configuration of the circumferential wall and side walls of the drive pinion as separate steel parts or even as integrally shaped parts out of sintered metal, they have a relatively high weight and require a large axial design space in or on the cylinder head of the internal combustion engine and, at the same time, they increase the manufacturing and mounting costs of such devices. Connecting the individual elements of the drive pinion to one another by screws has the further drawback that the bores required for the screws can lead to the formation of additional leak points, particularly in the side walls, and may have to be additionally sealed. A drive pinion made out of shaped sintered metal parts on the other hand, has the inherent drawback that rounded corners are formed at the inner transition from the circumferential wall to the side wall which make the fabrication of suitable wings more difficult or cause higher inner, pressure medium leakage in the device. Practice has further shown that in belt-driven devices whose camshaft-proximate side wall comprises an aperture for the camshaft having a shaft-seal receiving edge portion that is angularly disposed relative to the cylinder head, sintered metal is unsuitable as a running surface for the shaft seal that seals the device relative to the cylinder head.

OBJECTS OF THE INVENTION

It is therefore an object of the invention to provide a device for varying the valve timing of gas exchange valves of an internal combustion engine, and in particular a hydraulic camshaft adjusting device of a rotary piston type, which has a low weight and small overall dimensions, while being economic to manufacture and mount.

Another object of the invention is to provide the above device with a simple structure which reduces internal and external pressure medium leakage to a minimum.

These and other objects and advantages of the invention will become obvious from the following detailed description.

SUMMARY OF THE INVENTION

The invention achieves the above objects in a device of the initially described type by the fact that the camshaft-proximate side wall of the drive pinion is configured as a weight- and design space-saving component which is shaped out of a circular blank and at least partially surrounds the circumferential wall of the drive pinion while comprising an edge region that is bent at least almost at a right angle. The camshaft-distal side wall, the circumferential wall and the gearing of the drive pinion are fixed by common fastening means to one another, while the camshaft-proximate side wall is secured on the drive pinion by a separate connection that increases the axial stiffness of the side wall.

The common fixing of the camshaft-distal side wall, the circumferential wall and the gearing of the drive pinion is advantageously realized according to the invention in that the circumferential wall of the drive pinion comprises on an outer side thereof a preferably circumferentially continuous enlarged diameter connecting flange on whose rear side the camshaft-distal side wall and on whose front side the gearing of the drive pinion are secured by common screws. The camshaft-distal side wall has the same diameter as the connecting flange of the circumferential wall of the drive pinion and is in flat contact with this and with the camshaft-distal axial surfaces of the limiting walls of the drive pinion. To further reduce the weight of the device, the circumferential connecting flange may be replaced with a plurality of equally spaced local flanges on the outer side of the circumferential wall of the drive pinion, and/or the camshaft-distal side wall may be made with a diameter corresponding to the smaller diameter of the rest of the circumferential wall and with a corresponding number of flange lugs on its periphery. The gearing of the drive pinion is made preferably in the form of an annular toothed belt pulley which on its inner diameter likewise comprises a plurality of radial securing flanges which are in flat contact with the connecting flange of the circumferential wall of the drive pinion. However, it is also conceivable to use an annular chain wheel or other types of gearings and/or a circumferential radial flange in place of the separate radial securing flanges. The securing flanges of the gearing and the connecting flange of the circumferential wall of the drive pinion comprise aligned through-bores for the common screws at the fixing points, while the camshaft-distal side wall comprises corresponding threaded bores. To improve the sealing of camshaft-distal side wall relative to the drive pinion, advantageously, an O-ring is arranged therebetween preferably in an annular groove made in the connecting flange of the circumferential wall below the through-bores for the fixing screws.

According to a further advantageous proposition of the invention, the camshaft-proximate side wall that is configured as a thin-walled shaped part out of a circular blank with an angled edge region, is made preferably out of steel sheet by deep drawing. However, it is also conceivable and within the scope of the invention to use other manufacturing methods and/or materials for the camshaft-proximate side wall. For example, this side wall may be an aluminum die-cast part or an injection molded plastic element. The camshaft-proximate side wall of the drive pinion is configured preferably for use in a belt-driven device and comprises, in a known manner, a central aperture for the camshaft and an edge region of the aperture is bent at an angle towards the cylinder head and its outer surface serves as a running surface for a shaft seal that seals the device relative to the cylinder head. In the equally possible case that the camshaft-proximate side wall is configured for a chain- or gear-driven device, the angled configuration of the edge region of the aperture in not required because in such devices, a sealing relative to the cylinder head is not absolutely necessary.

In a first preferred embodiment, the separate connection of the camshaft-proximate wall to the drive pinion is achieved by fixing it directly on the camshaft-proximate axial side surfaces of the limiting walls of the drive pinion by laser spot welding. However, other suitable welding methods such as, for example, capacitor discharge welding or friction welding may also be used for this purpose in place of laser welding. With regard to the durability of the connection and the axial stiffness of the camshaft-proximate wall, it has proved to be sufficient to provide a single spot weld approximately at the center of the axial surface of each limiting wall, but the number and location of the spot welds can be chosen at will. To improve the sealing of the camshaft-proximate side wall relative to the drive pinion, it is likewise advantageous to arrange an O-ring therebetween which is appropriately inserted in this case into a circumferential recess at the transition from the outer surface of the circumferential wall to its camshaft-proximate axial surface and seals at the inner surface of the angled edge region of the camshaft-proximate side wall against pressure medium leakage.

In a second embodiment of the separate connection of the camshaft-proximate side wall to the drive pinion, the camshaft-proximate side wall is undetachably fixed on the drive pinion, preferably by gluing, the gluing surfaces for the camshaft-proximate side wall being formed by the camshaft-proximate axial surfaces of the limiting walls and the circumferential wall of the drive pinion. For a further reduction of the weight of the device, it is advantageous in this embodiment to reduce the volume of the limiting walls of the drive pinion by through-bores extending parallel to the central longitudinal axis of the device, and in the case of a drive pinion made of sintered metal, by apertures integrally formed therein during sintering. The gluing surface for the camshaft-proximate side wall thus reduced by the area of the through-bores or apertures is still large enough for assuring a durable connection to the drive pinion. An O-ring similarly arranged as in the previous embodiment seals the camshaft-proximate wall relative to the drive pinion against pressure medium leakage.

In a third embodiment of the separate connection of the camshaft-proximate side wall to the drive pinion, this side wall is fixed to the drive pinion preferably by fluid-tight soldering. For this purpose, the camshaft-proximate axial surface of the circumferential wall of the drive pinion preferably comprises a circumferential annular groove into which a ring-shaped solder is inserted and heated together with the circumferential wall and the camshaft-proximate side wall and fuses with these walls. The heating of the shaped solder can be done either by placing the drive pinion with inserted solder in a furnace or by heating only the soldering region of the drive pinion by induction heating. With a view to the high operating temperatures of an internal combustion engine, the shaped solder is advantageously a brazing solder, the choice of its alloy being determined by the materials used for the circumferential wall and the side wall of the drive pinion. For a further reduction of the weight of the device, it is advantageous in this case too, to reduce the volume of the limiting walls of the drive pinion by providing through-bores or apertures similar to the previous embodiment. The arrangement of an O-ring for sealing the camshaft-proximate side wall relative to the drive pinion can, however, be omitted in the present embodiment because, on the one hand, sealing against pressure medium leakage is achieved already by the fluid-tight soldering, and on the other hand, because an O-ring would be damaged by the heating of the solder.

In a device in which the circumferential wall of the drive pinion is made of a non-weldable material or of a material that is difficult to weld, the separate connection of the camshaft-proximate side wall to the drive pinion can be realized, in a fourth embodiment, by welding this side wall to steel spring bushings additionally arranged in the drive pinion. For this purpose, the limiting walls of the drive pinion comprise stepped apertures extending parallel to the central longitudinal axis of the device. The spring bushings, that are preferably hat-shaped, are inserted into these apertures so that their head-end rim is supported on the steps of the apertures and their foot ends bear flatly against the camshaft-proximate axial surfaces of the limiting walls and close the apertures. The spring bushings are preferably hollow and made of a spring steel in order to obtain a clearance-free connection of the camshaft-proximate side wall to the drive pinion. The spring force of the spring bushings must be greater than the axial force acting on the camshaft-proximate side wall through the pressure of the hydraulic pressure medium in the device. The most suitable welding method for fixing the camshaft-proximate side wall to the spring bushings has proved to be laser welding with one spot weld per spring bushing, but it is also possible to use other welding methods such as capacitor discharge welding or friction welding and/or make more than one spot weld per spring bushing. Moreover, in this embodiment, too, it is advantageous to arrange an O-ring between the camshaft-proximate side wall and the drive pinion in a manner similar to the first embodiment to obtain improved sealing.

Another possibility of making the separate connection of the camshaft-proximate side wall to the drive pinion in a device in which the circumferential wall of the drive pinion or also the camshaft-proximate side wall is made of a non-weldable material or of a material that is difficult to weld is proposed in a fifth embodiment. The limiting walls of the drive pinion in this embodiment likewise comprise stepped apertures that extend parallel to the central longitudinal axis of the device, and head ends of countersunk rivets inserted into the apertures bear against the steps of the apertures. On a level with the apertures of the limiting walls, the camshaft-proximate side wall comprises axial counterbores so that it can fixed on the drive pinion by riveting the foot ends of the rivets flush with its outer surface. An O-ring arranged in a manner similar to the first embodiment serves in this embodiment, as well, to seal the camshaft-proximate wall relative to the drive pinion against pressure medium leakage.

In a sixth embodiment of the separate connection of the camshaft-proximate side wall to the drive pinion, the outer surface of the circumferential wall of the drive pinion is configured with a shoulder formed by a slight diameter reduction and the camshaft-proximate side wall of the drive pinion is clipped onto this shoulder by a circumferential lug provided on the inner side of the end of the side wall edge region. In place of the circumferential lug, it is also possible to provide a plurality of separate lugs on the inner side of the angled edge region. The sealing of the camshaft-proximate side wall relative to the drive pinion against pressure medium leakage is obtained in this case, too, by an O-ring arranged therebetween. However, to save space, the O-ring is disposed, in this embodiment, preferably in an annular groove provided in the camshaft-proximate axial surface of the circumferential wall of the drive pinion.

Alternatively to the sixth embodiment, it is proposed in a seventh embodiment of the separate connection of the camshaft-proximate side wall to the drive pinion, to make the diameter reduction on the outer side of the circumferential wall of the drive pinion, and therefore also the shoulder thus formed, a little larger, and to fix the camshaft-proximate side wall to the drive pinion by bending the end of the edge region of the side wall around the shoulder of the circumferential wall. The required sealing of the camshaft-proximate side wall relative to the drive pinion against pressure medium leakage is again realized by an O-ring arranged in a manner similar to the first embodiment.

Finally, in an eighth embodiment, the separate connection of the camshaft-proximate side wall to the drive pinion is made by a flow of material of the side wall. For achieving this, the limiting walls of the drive pinion are again provided with through-bores or apertures that extend parallel to the central longitudinal axis of the device, and the camshaft-proximate side wall of the drive pinion is pressed from its outer side at appropriate points into these through-bores or apertures so as to be inseparably clamped therein. In a variation of this embodiment, the through-bores or apertures in the limiting walls have a stepped configuration, and hat-shaped spring bushings of a configuration similar to that in the fourth embodiment are inserted therein to project out of the through-bores or apertures by a length corresponding approximately to the thickness of the material of the side wall. On a level with these through-bores or apertures, the camshaft-proximate side wall comprises axial bores whose diameter is slightly smaller than the outer diameter of the spring bushings. By pressing the spring bushings into these axial bores, the camshaft-proximate side wall can again be inseparably clamped on the drive pinion by a flow of material. The required sealing of the camshaft-proximate side wall relative to the drive pinion against pressure medium leakage is realized in this embodiment likewise preferably by an O-ring arranged in a like manner to the first embodiment.

The device of the invention for varying the valve timing of gas exchange valve of an internal combustion engine, which is in particular a hydraulic camshaft adjusting device of a rotary-piston type, thus has the advantage over prior art camshaft adjusting devices that, due to the configuration of the camshaft-proximate side wall as a thin-walled, shaped circular blank, the device of the invention has a reduced weight and smaller overall dimensions. Further, due to the configuration of the camshaft-proximate side wall as a deep drawn steel sheet part, the device of the invention has the advantage of a simple structure which, in the final analysis, also enables an economic manufacture of the device. Moreover, the different possibilities of establishing the separate connection of the camshaft-proximate side wall likewise reduce the mounting costs of the device of the invention. The connection of the camshaft-distal side wall, the circumferential wall and the gearing of the drive pinion to one another by common fasteners whose position is shifted out of the device onto a connecting flange, offers the further advantage that the device of the invention requires only minor measures for preventing internal and external pressure medium leakage.

The invention will now be described more closely with reference to examples of embodiments shown in the appended drawings.

DETAILED DESCRIPTION OF THE DRAWINGS

Figure 1:
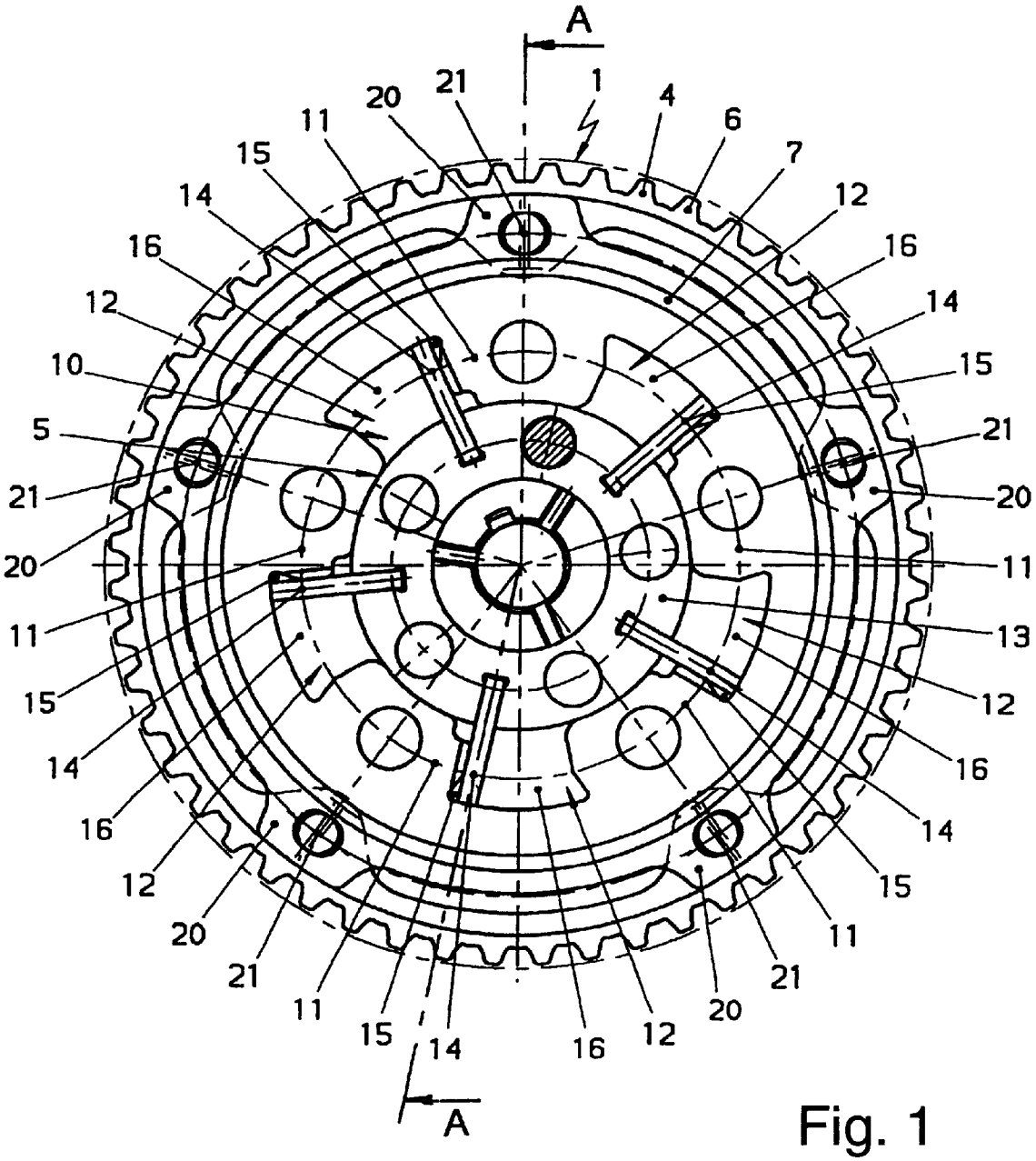
FIG. 1 is a top view of a device of the invention in which the camshaft-distal side wall of the drive pinion has been removed.
Figure 2:
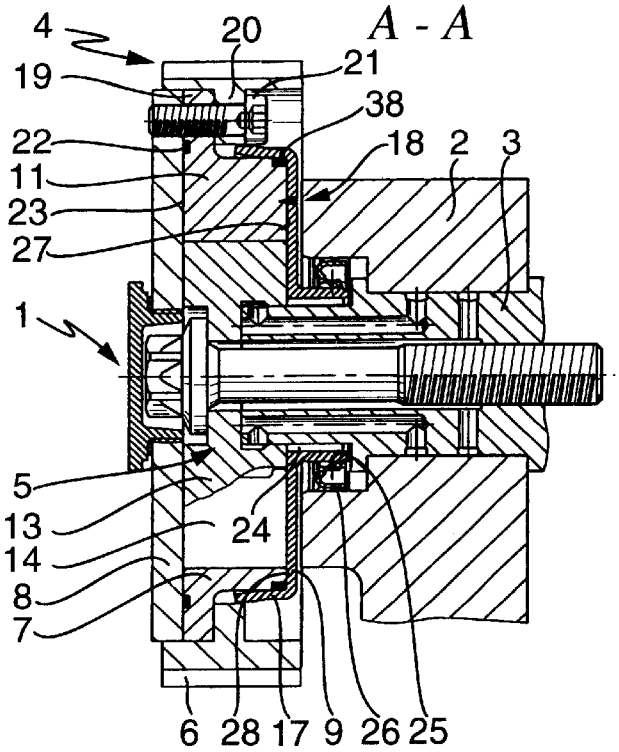
FIG. 2 is a sectional view along line A—A of FIG. 1 showing a first embodiment of the separate connection of the camshaft-proximate side wall to the drive pinion.

FIGS. 1 and 2 illustrate a hydraulic camshaft adjusting device 1 of a rotary piston type with which the opening and closing times of gas exchange valves of an internal combustion engine can be varied as a function of different parameters of operation. This device 1 is arranged on the drive-proximate end of a camshaft 3 mounted in the cylinder head 2 of the internal combustion engine, and generally comprises a drive pinion 4 configured as an outer rotor and a winged wheel 5 configured as an inner rotor. The drive pinion 4 is in driving relation with a crankshaft of the internal combustion engine through a circumferential gearing 6, and the winged wheel 5 is fixedly mounted on the camshaft of the internal combustion engine. It can be seen further in FIGS. 1 and 2 that the drive pinion 4 is made up of a hollow cylindrical circumferential wall 7, a camshaft-distal side wall 8 and a camshaft-proximate side wall 9, which walls are connected to one another and together define a hollow space 10 in the drive pinion 4. Five limiting walls 11 start from an inner side of the circumferential wall 7 and extend in radial direction toward the central longitudinal axis of the device 1 to form five hydraulic working chambers 12 in the hollow space 10. On the periphery of its hub 13, the winged wheel 5 comprises five wings 14 that are held in axial grooves in the hub 13 and extend radially into the working chambers 12 of the drive pinion 4 and divide each working chamber 12 into two hydraulic pressure chambers 15, 16. By a selective or a simultaneous pressurization of the pressure chambers 15, 16 with a hydraulic pressure medium, a rotation or a hydraulic clamping of the winged wheel 5 relative to the drive pinion 4, and thus a relative rotation or fixing of the camshaft 3 relative to the crankshaft of the internal combustion engine, is effected.

FIG. 2 further shows that the camshaft-distal side wall 8, the circumferential wall 7 and the gearing 6 of the drive pinion 4 in the form of an annular toothed belt pulley are connected to one another by common fastening by the fact that the circumferential wall 7 of the drive pinion 4 comprises on its outer side, in accordance with the invention, a circumferential connecting flange 19 on whose camshaft-distal surface the camshaft-distal side wall 8 and on whose camshaft-proximate surface the gearing 6 of the drive pinion 4 are fixed by common screws 21. The camshaft-distal side wall 8 has the same diameter as the connecting flange 19 of the circumferential wall 7 and bears flatly against this connecting flange 19 and against the camshaft-distal axial surfaces 23 of the limiting walls 11 of the drive pinion 4. On its inner diameter, the gearing 6 comprises a plurality of radial securing flanges 20 for fixing on the connecting flange 19 of the circumferential wall 7. These radial securing flanges 20 and the connecting flange 19 comprise through-bores aligned to one another and to threaded bores of the camshaft-distal side wall 8 for receiving the screws 21. For sealing the camshaft-distal side wall 8 relative to the drive pinion 4, an O-ring 22 is inserted into a circumferential annular groove made in the connecting flange 19 below the through-bores for the screws 21.

It can be seen further in FIG. 2 of the drawings that the camshaft-proximate side wall 9 of the drive pinion 4 is made in accordance with the invention as a weight- and design space-saving, thin-walled part shaped from a circular blank which has an edge region 17 bent at a right angle to partially surround the circumferential wall 7 of the drive pinion 4 and which is undetachably fixed on the drive pinion 4 by a separate connection 18 that augments its axial stiffness. This camshaft-proximate side wall 9 is made of a deep drawn steel sheet which has a configuration suitable for use in a belt-driven device 1, i.e. it comprises, in a known manner, a central aperture 24 for the camshaft 3, the edge region 25 of the aperture 24 is bent towards the cylinder head 2 and forms, on its outer side, a running surface for a shaft ring 26. The separate connection 18 of the camshaft-proximate side wall 9 to the drive pinion 4 is realized in the first embodiment shown in FIG. 2 by laser spot welding directly on the camshaft-proximate axial surfaces 27 of the limiting walls 11 of the drive pinion 4. For sealing the cam-shaft proximate side wall 9 relative to the drive pinion 4 against pressure medium leakage, a circumferential recess is arranged at the transition from the outer surface of the circumferential wall 7 to its camshaft-proximate axial surface 28, and an O-ring 38 is inserted into this circumferential recess to effect sealing on an inner surface of the angled edge region 17 of the camshaft-proximate side wall 9.

Figure 3:
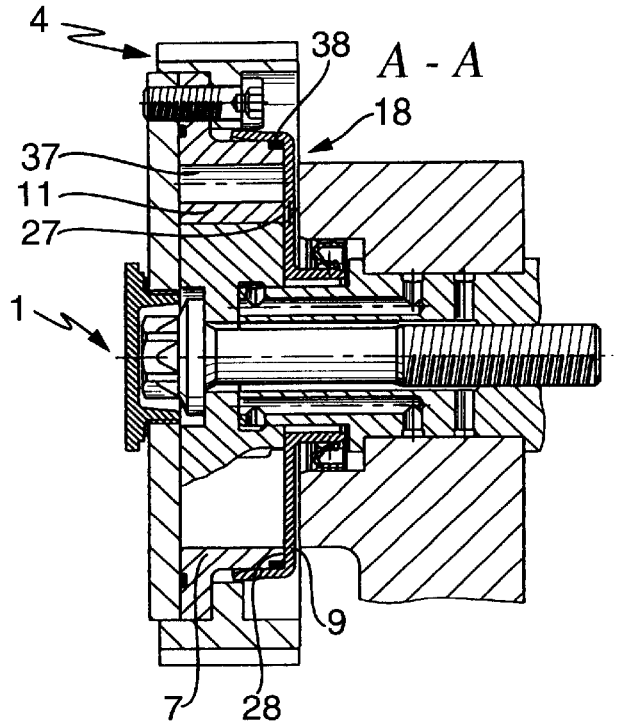
FIG. 3 is a sectional view along line A—A of FIG. 1 showing a second embodiment of the separate connection of the camshaft-proximate side wall to the drive pinion.

In the second embodiment of the separate connection 18 of the camshaft-proximate side wall 9 shown in FIG. 3, this wall is fixed on the drive pinion 4 by gluing to the camshaft-proximate axial surfaces 27 of the limiting walls 11 and to the camshaft-proximate axial surface 28 of the circumferential wall 7. To obtain a further reduction of weight in the device 1 of this embodiment, the volume of the limiting walls 11 of the drive pinion 4 is reduced by through-bores 37 extending parallel to the central longitudinal axis of the device 1. The sealing of the camshaft-proximate side wall 9 relative to the drive pinion 4 against pressure medium leakage is effected in a manner similar to the first embodiment by an O-ring 38.

Figure 4:
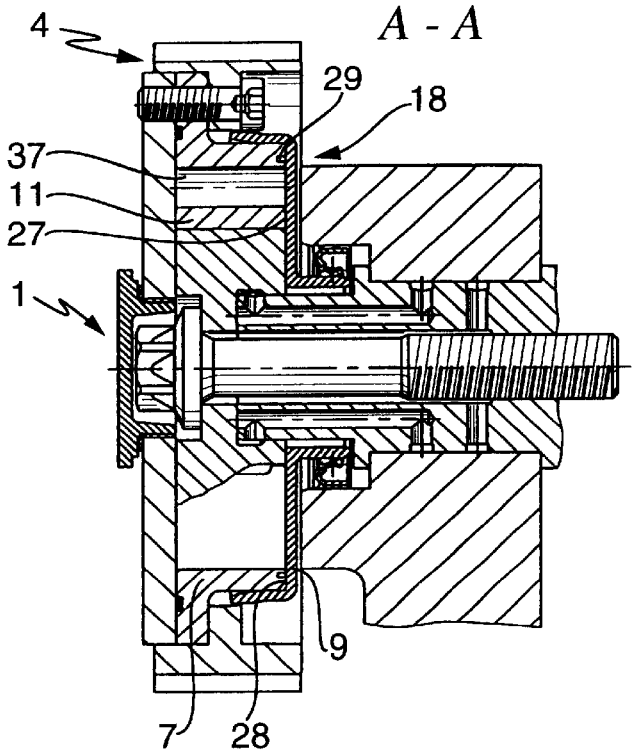
FIG. 4 is a sectional view along line A—A of FIG. 1 showing a third embodiment of the separate connection of the camshaft-proximate side wall to the drive pinion.

A third embodiment of the separate connection 18 of the camshaft-proximate side wall 9 to the drive pinion 4 is shown in FIG. 4. In this embodiment, the camshaft-proximate axial surface 28 of the circumferential wall 7 comprises a circumferential annular groove 29 into which a ring-shaped solder is inserted. This shaped solder is liquefied by heating the circumferential wall 7 with the camshaft-proximate side wall 9 placed thereon so that the camshaft-proximate side wall 9 is fixed on the drive pinion 4 by fluid-tight soldering. The through-bores 37 provided in the limiting walls 11 in this embodiment likewise serve to reduce the weight of the device 1. A separate sealing between the camshaft-proximate side wall 9 and the drive pinion 4 can be omitted in this embodiment.

Figure 5:
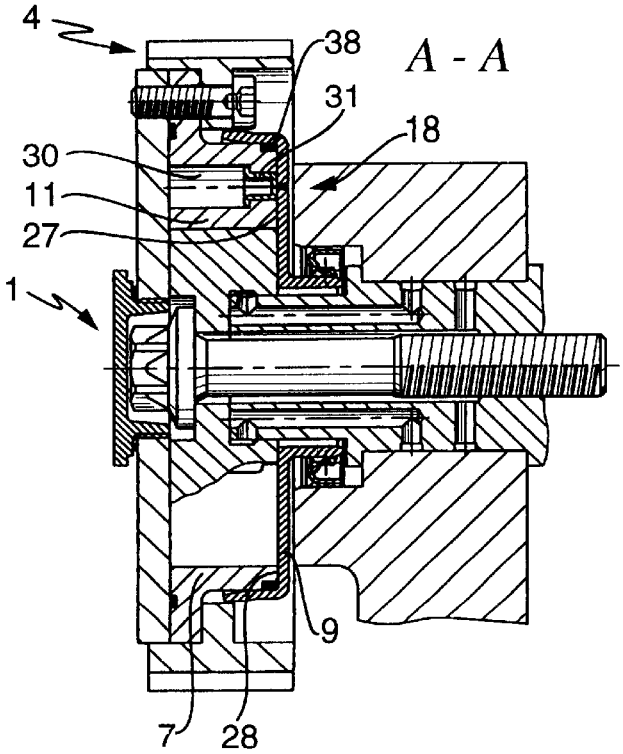
FIG. 5 is a sectional view along line A—A of FIG. 1 showing a fourth embodiment of the separate connection of the camshaft-proximate side wall to the drive pinion.

The fourth embodiment of the separate connection 18 of the camshaft-proximate side wall 9 to the drive pinion 4 shown in FIG. 5 is specially suitable for a device 1 whose circumferential wall 17 is made of a non-weldable material or of a material that is difficult to weld, and whose camshaft-proximate side wall 9 still has to be fixed to the drive pinion 4 by welding. For this purpose, the limiting walls 11 of the drive pinion 4 comprise stepped apertures 30 that extend parallel to the central longitudinal axis of the device 1, into which apertures 30 hat-shaped steel spring bushings 31 are inserted in the manner indicated in FIG. 5. With the help of these spring bushings 31, the camshaft-proximate side wall 9 can be fixed on the drive pinion 4 likewise by laser welding. For sealing the camshaft-proximate side wall 9 relative to the drive pinion 4, an O-ring is likewise inserted therebetween in the same manner as in the first embodiment.

Figure 6:
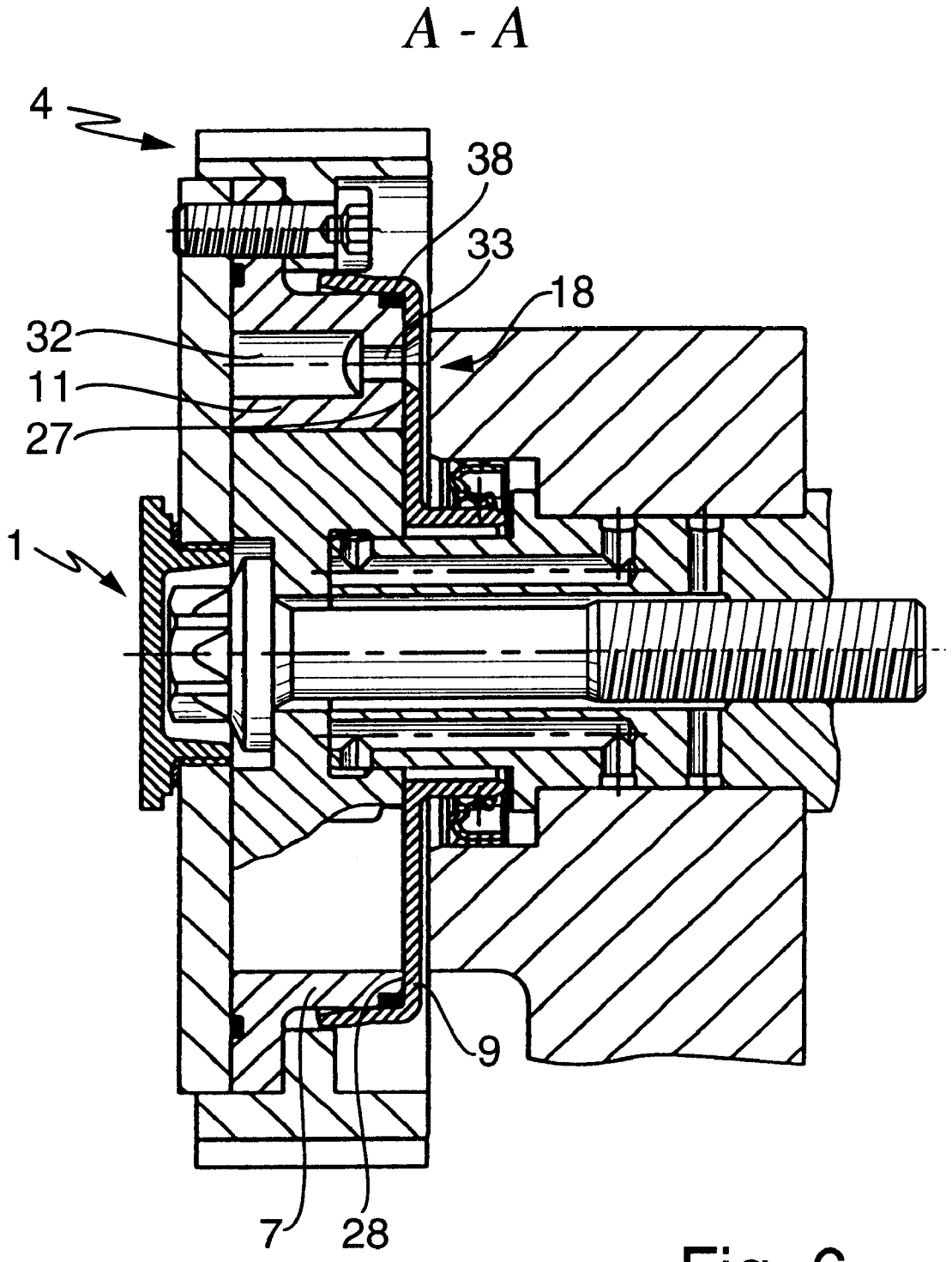
FIG. 6 is a sectional view along line A—A of FIG. 1 showing a fifth embodiment of the separate connection of the camshaft-proximate side wall to the drive pinion.

In the fifth embodiment of the separate connection 18 of the camshaft-proximate side wall 9 to the drive pinion 4 shown in FIG. 6, the limiting walls 11 of the drive pinion 4 likewise comprise stepped apertures 32 extending parallel to the central longitudinal axis of the device 1, into which apertures, however, in this embodiment, countersunk rivets 33 are arranged with their head ends on the steps of the apertures 32. On a level with these apertures 32, the camshaft-proximate side wall 9 comprises axial counterbores, not referenced, so that the side wall 9 can be fixed on the drive pinion 4 by riveting the countersunk rivets 33 that extend into the counterbores. An O-ring 38 arranged in a manner similar to the first embodiment serves in this case, too, to seal the camshaft-proximate wall 9 relative to the drive pinion 4.

Figure 7:
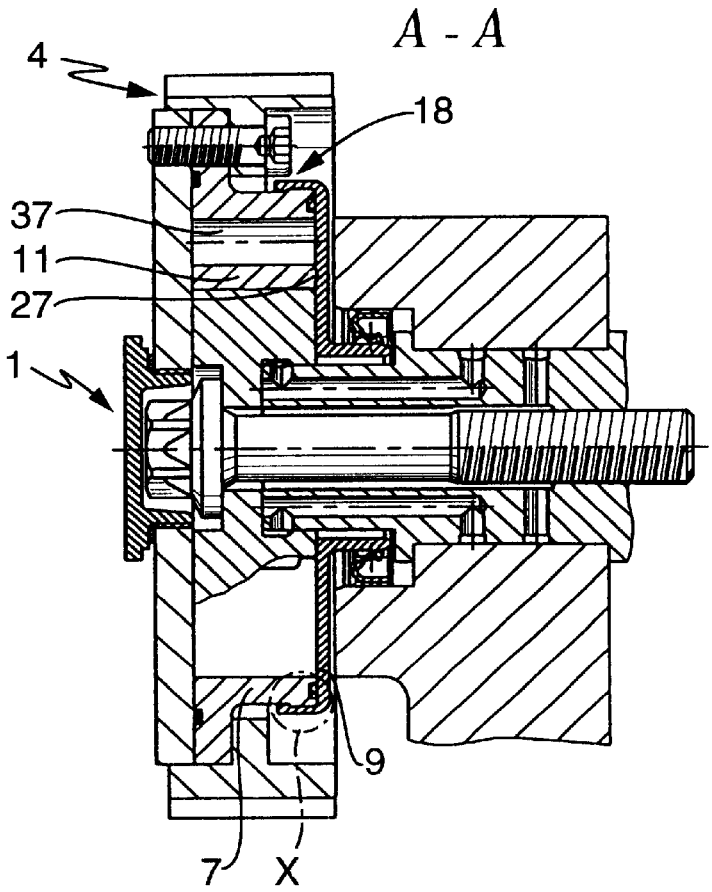
FIG. 7 is a sectional view along line A—A of FIG. 1 showing a sixth embodiment of the separate connection of the camshaft-proximate side wall to the drive pinion.
Figure 8:
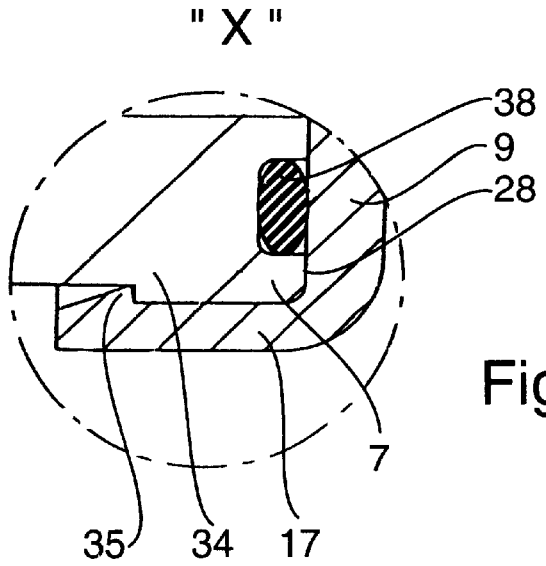
FIG. 8 is an enlarged representation of the detail X of FIG. 7.

The sixth embodiment of the separate connection 18 of the camshaft-proximate side wall 9 to the drive pinion 4 shown in FIGS. 7 and 8 is particularly economic. As can be seen in the enlarged representation of FIG. 8, a circumferential shoulder 34 is formed on the outer surface of the circumferential wall 7 of the drive pinion 4 by a slight diameter reduction, while the inner surface of the end of the angled edge region 17 of the camshaft-proximate side wall 9 is configured with a complementary circumferential lug 35. Thus, the camshaft-proximate side wall 9 can be fixed on the drive pinion 4 by simply clipping it onto the shoulder 34 of the circumferential wall 7. The through-bores 37 provided in the limiting walls 11 again serve to further reduce the weight of the device 1. The sealing of the camshaft-proximate side wall 9 relative to the drive pinion 4 is again achieved by an O-ring 38 arranged therebetween which, however, in this embodiment, is inserted into an annular groove, not referenced, made in the camshaft-proximate axial surface 28 of the circumferential wall 7.

Figure 9:
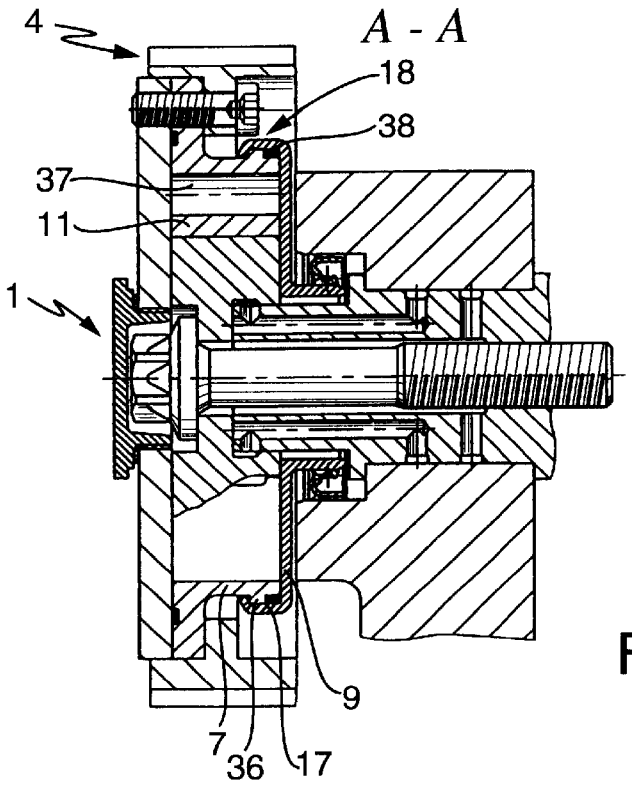
FIG. 9 is a sectional view along line A—A of FIG. 1 showing a seventh embodiment of the separate connection of the camshaft-proximate side wall to the drive pinion.

The embodiment of the separate connection 18 of the camshaft-proximate side wall 9 to the drive pinion 4 shown in FIG. 9 is an alternative to the previous embodiment. In this alternative embodiment, the diameter reduction of the outer surface of the circumferential wall 7 and the circumferential shoulder 36 formed thereby are slightly larger so that the camshaft-proximate side wall 9 can be fixed on the drive pinion 4 by bending over the end of the edge region 17 of the camshaft-proximate side wall 9 over this shoulder 36 of the circumferential wall 7. For sealing the camshaft-proximate side wall 9 relative to the drive pinion 4, an O-ring 38 is again arranged therebetween in a manner similar to the first embodiment, and the through-bores 37 provided in the limiting walls 11 likewise serve to reduce the weight of the device 1.

Figure 10:
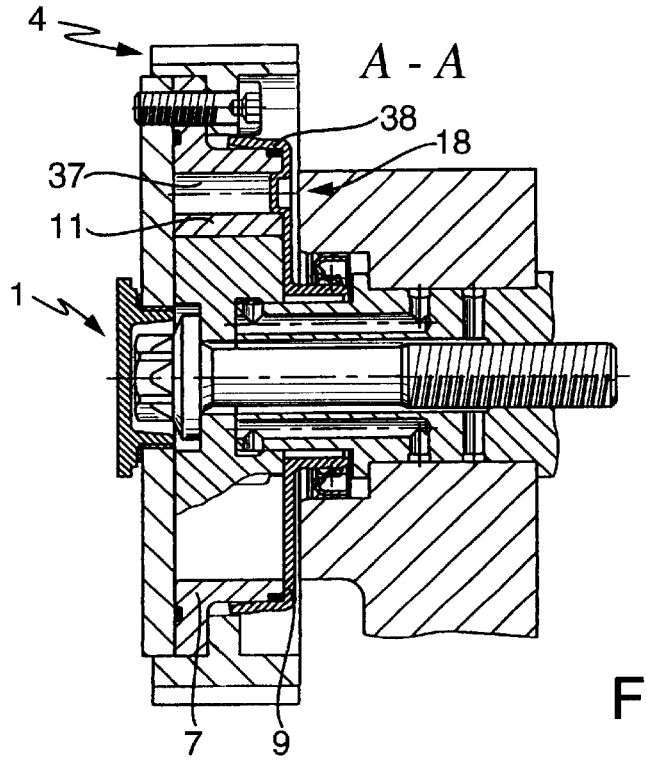
FIG. 10 is a sectional view along line A—A of FIG. 1 showing an eighth embodiment of the separate connection of the camshaft-proximate side wall to the drive pinion.

Finally, in the embodiment of the separate connection 18 of the camshaft-proximate side wall 9 to the drive pinion 4 shown in FIG. 10, the through-bores 37 extending parallel to the central longitudinal axis of the device 1 in the limiting walls 11 serve not only to reduce the weight of the device 1 but are also used for fixing the camshaft-proximate side wall 9 on the drive pinion 4. This is done by a displacement of material of the camshaft-proximate side wall 11 from the outside at appropriate points into these through-bores 37, which results in a clamping of the side wall 9 on the drive pinion 4 without the use of further fastening means. An O-ring 38 arranged in a manner similar to the first embodiment serves in this embodiment, as well, to seal the camshaft-proximate side wall 9 relative to the drive pinion 4.

What is claimed is:

1. A hydraulic camshaft adjusting device of a rotary piston type, comprising:

the device is disposed on a drive-proximate end of a camshaft mounted in a cylinder head of an internal combustion engine and generally comprises a drive pinion configured as an outer rotor and a winged wheel configured as an inner rotor;

the drive pinion is in driving relation with a crankshaft of the internal combustion engine through a circumferential gearing, and the winged wheel is fixedly mounted on the camshaft;

the drive pinion comprises a hollow cylindrical circumferential wall, a camshaft-distal side wall and a camshaft-proximate side wall, said circumferential and side walls being connected to one another and together defining a hollow space;

at least one hydraulic working chamber is formed in the hollow space of the drive pinion by at least two limiting walls that start from an inner side of the circumferential wall and extend in radial direction toward a central longitudinal axis of the device;

a hub of the winged wheel comprises at least one wing on a periphery thereof which wing extends in radial direction into the working chamber of the drive pinion and divides the working chamber into two hydraulic pressure chambers;

a rotation or a fixing of the winged wheel relative to the drive pinion, and thus also of the camshaft relative to the crankshaft, is effected respectively by a selective or a simultaneous pressurization of the pressure chambers with a hydraulic pressure medium;

the camshaft-proximate side wall of the drive pinion is configured as a weight- and design space-saving thin-walled component which is shaped out of a circular blank and at least partially surrounds the circumferential wall of the drive pinion while comprising a bent edge region that is bent at least almost at a right angle;

the camshaft-distal side wall, the circumferential wall and the gearing of the drive pinion are fixed by common fastening to one another, and the camshaft-proximate side wall is undectachably fixed on the drive pinion by a separate connection that increases an axial stiffness of the camshaft-proximate side wall;

the circumferential wall of the drive pinion comprises on am outer side a circumferential, enlarged diameter connecting flange on whose rear side the camshaft-distal side wall having a diameter equal to the diameter of the connecting flange, and on whose front side the gearing of the drive pinion are secured by common screws, said gearing being configured as an annular toothed belt pulley and comprising a plurality of radial securing flanges.

2. A device of claim 1 wherein the camshaft-proximate side wall of the drive pinion is made of a deep drawn steel sheet comprising a central aperture for the camshaft, an edge region of the aperture is bent at an angle toward the cylinder head and serves as a running surface for a shaft seal so that the camshaft-proximate side wall is suitable for use in a belt-driven device.

3. A device of claim 1 wherein the camshaft-proximate side wall of the drive pinion is fixed by laser spot welding directly on camshaft-proximate axial surfaces of the limiting walls of the drive pinion.

4. A device of claim 1 wherein the camshaft-proximate side wall of the drive pinion is fixed by gluing on camshaft-proximate axial surfaces of the limiting walls and of the circumferential wall of the drive pinion.

5. A device of claim 1 wherein a camshaft-proximate axial surface of the circumferential wall of the drive pinion comprises a circumferential annular groove into which a ring-shaped solder is inserted, which solder, upon heating, fixes the camshaft-proximate side wall of the drive pinion by fluid-tight soldering on the drive pinion.

6. A device of claim 1 wherein the limiting walls of the drive pinion comprise stepped apertures that extend parallel to a central longitudinal axis of the device, and the camshaft-proximate side wall of the drive pinion is fixed on the drive pinion by welding to spring bushings whose head ends bear against steps of the apertures.

7. A device of claim 1 wherein the limiting walls of the drive pinion comprise stepped apertures that extend parallel to a central longitudinal axis of the device, and the camshaft-proximate side wall of the drive pinion is fixed on the drive pinion by riveting with help of countersunk rivets whose head ends bear against steps of the apertures.

8. A device of claim 1 wherein an outer surface of the circumferential wall of the drive pinion comprises a circumferential shoulder formed by a slight diameter reduction, and the camshaft-proximate side wall of the drive pinion is fixed on the drive pinion by clipping onto the shoulder of the circumferential wall with help of a circumferential lug formed on an inner surface of an end of the bent edge region of the camshaft-proximate side wall.

9. A device of claim 1 wherein an outer surface of the circumferential wall of the drive pinion comprises a circumferential shoulder formed by a slight diameter reduction, and the camshaft-proximate side wall of the drive pinion is fixed on the drive pinion by bending over an end of the bent edge region of the camshaft-proximate side wall around the shoulder of the circumferential wall.

10. A device of claim 1 wherein the limiting walls of the drive pinion comprise through-bores that extend parallel to a central longitudinal axis of the device, and the camshaft-proximate side wall of the drive pinion is fixed on the drive pinion by a pointwise displacement of an outer side of the camshaft-proximate side wall into these through-bores.

* * * * *